US005269704A

United States Patent [19]

Ohashi

[11] Patent Number: 5,269,704

[45] Date of Patent: Dec. 14, 1993

[54] CONNECTOR EVALUATING ADAPTER

[75] Inventor: Yoshinori Ohashi, Urayasu, Japan

[73] Assignee: Kitagawa Industries Co., Ltd., Japan

[21] Appl. No.: 834,465

[22] Filed: Feb. 12, 1992

[30] Foreign Application Priority Data

Feb. 16, 1991 [JP] Japan ..... 3-22434

[51] Int. Cl.[5] ..... H01R 13/66

[52] U.S. Cl. ..... 439/620; 437/95

[58] Field of Search ..... 439/620, 609, 95

[56] References Cited

U.S. PATENT DOCUMENTS 4,215,326 7/1980 Hollyday ..... 439/620 X

FOREIGN PATENT DOCUMENTS 0003162 7/1979 European Pat. Off. .
1490503 11/1977 United Kingdom .
2014804 8/1979 United Kingdom .
2025158 1/1980 United Kingdom .
2205201 11/1988 United Kingdom .

*Primary Examiner*—Eugene F. Desmond
*Attorney, Agent, or Firm*—Davis, Bujold & Streck

[57] ABSTRACT

A connector evaluating adapter composed of ground electrodes of connector terminal ends electrically interconnected via a metal housing. Through capacitors are used between opposed signal electrodes of the connector terminal ends. External electrodes of the through capacitors are electrically connected to a metal plate, and the metal plate is connected via conductive members to the ground electrodes, such that the metal plate corresponds to an electrical midpoint between the ground electrodes. When high-frequency noise flows into the ground electrodes, the ground electrodes and the metal plate are equipotential. After the through capacitors eliminate superimposed noise from electrical signals, the metal plate again becomes almost equipotential to the ground electrodes. Since both ends of the metal housing are equipotential, no current flows through the metal housing, thus generating no noise.

6 Claims, 5 Drawing Sheets

CONNECTOR EVALUATING ADAPTER

BACKGROUND OF THE INVENTION

This invention relates to a connector evaluating adapter for evaluating a noise eliminating effect of a connector in which noise superimposed on electrical signals passing through signal electrodes is eliminated via through type capacitors, the electrical signals then being transmitted to an electronic circuit.

Conventionally, in a known noise filtering connector, through-type capacitors are connected in parallel with multiple signal electrodes for receiving and transmitting electrical signals and a ground electrode for holding the signal electrodes via an insulating member is electrically connected to external electrodes of the through-type capacitors. In the noise filtering connector, after noise superimposed on the electrical signals passing through the signal electrodes is eliminated, the electrical signals are transmitted to an electronic circuit.

For example, as shown in FIG. 5, a prior-art noise filtering connector 51 is composed of a connector terminal 53 bearing four signal electrodes (not shown), which are connected to internal electrodes 55*a* of through capacitors 55. The through capacitors 55 extend from the connector terminal 53 into a metal plate 57 comprising a bottom surface of the noise filtering connector 51. External electrodes 55*b* of the through capacitors 55 are electrically connected via the metal plate 57 and associated conductive members 59 to a ground electrode 53*a* of the connector terminal 53.

In the noise filtering connector 51, noise superimposed on electrical signals passing through the signal electrodes enclosed in the connector terminal 53 is eliminated via the through capacitors 55. The electrical signals having no noise can thus be transmitted to an electronic circuit.

In such a known noise filtering connector, the frequency of noise to be eliminated by a through capacitor is determined by the capacitance of the through capacitor. Therefore, according to the frequency of electrical signals to be received or transmitted, the capacitance of the through capacitor has to be established. Multiple noise filtering connectors provided with through capacitors having various capacitances are first prepared, and the noise filtering connectors are sequentially attached to an electronic circuit to check their noise filtering effect and select the noise filtering connector most suitable for the electronic circuit.

When the most suitable connector has been selected, solder applied to the connector to be replaced needs to be removed and another connector needs to be soldered to the electronic circuit. Such soldering steps make more troublesome the selection of the connector most suitable to the electronic circuit.

SUMMARY OF THE INVENTION

Wherefore, an object of this invention is to provide a connector evaluating adapter that facilitates the selection of a noise filtering connector most suitable to use with an electronic circuit.

Other objects and benefits of the invention will become apparent from the detailed description which follows hereinafter when taken in conjunction with the drawing figures which accompany it.

To solve this and other objects, this invention provides a connector evaluating adapter for evaluating a noise eliminating effect of a noise filter connector. The connector evaluating adapter comprises a pair of connector ends, each having a ground electrode; at least one signal electrode extending between the connector ends; a through capacitor encompassing and connected to the signal electrode and defining an external electrode electrically conductively contacting a metal plate; an electrically conductive housing encompassing the through capacitor and electrically conductively interconnecting the ground electrodes; and a conductive member electrically conductively interconnecting the metal plate and the ground electrodes, the metal plate being disposed between the ground electrodes.

Also according to the invention there is provided a method of ascertaining the capacitance required for a through capacitor encompassing a signal electrode in a noise filtering connector. The method comprises the steps of providing a plurality of connector evaluating adapters. Each of the adapters comprises a pair of connector ends, each having a ground electrode; at least one signal electrode extending between the connector ends; a through capacitor encompassing and connected to the signal electrode and defining an external electrode electrically conductively contacting a metal plate; an electrically conductive housing encompassing the through capacitor and electrically conductively interconnecting the ground electrodes; and a conductive member electrically conductively interconnecting the metal plate and the ground electrodes, the metal plate being disposed between the ground electrodes. The connector ends are symmetrically opposed, the ground electrodes encompass the signal electrode at their respective connector ends, the through capacitors are disposed midway between the connector ends, and the plate is disposed at an electrical midpoint between the ground electrodes. The method further comprises the steps of connecting each of the adapters in turn, by way of a member having no noise filtering function, to an electronic circuit; supplying electrical signals to the circuit by way of the adapters; evaluating the noise eliminating effect of the adapters; and from the effects selecting the desired capacitance of the noise filtering connector.

BRIEF DESCRIPTION OF THE DRAWINGS

The invention will now be described, by way of example, with reference to the accompanying drawings, in which.

DETAILED DESCRIPTION OF THE PREFERRED EMBODIMENTS

Figure 1:
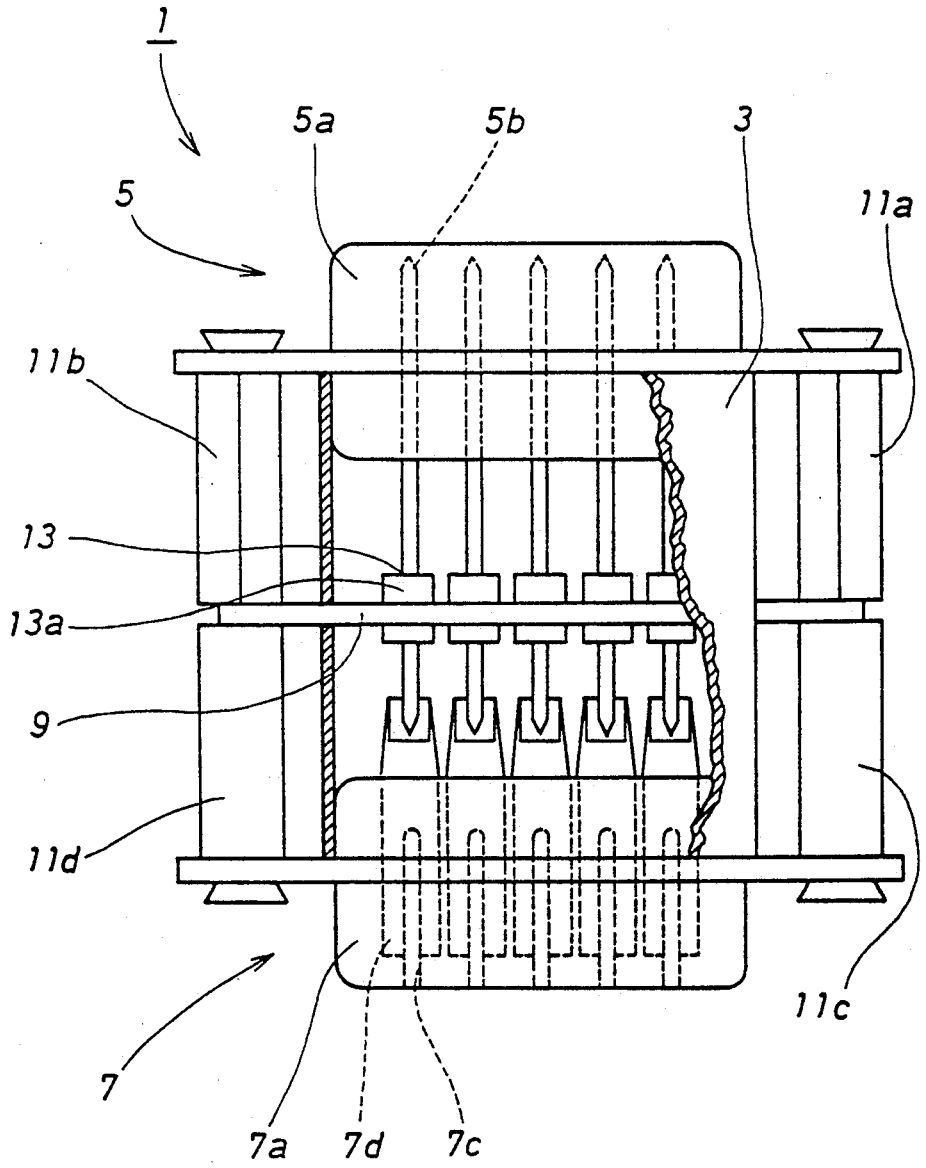
FIG. 1 is a diagrammatic view showing an internal structure of a connector evaluating adapter of a first embodiment of the present invention.
Figure 2:
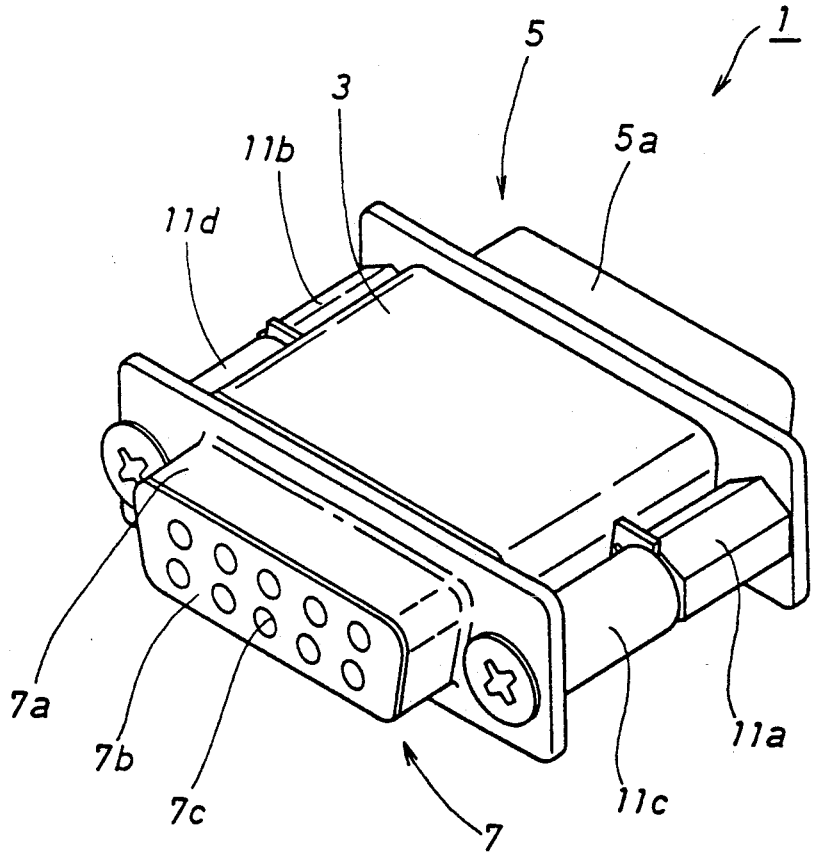
FIG. 2 is a perspective view showing an external appearance of the connector evaluating adapter shown in FIG. 1.

With reference to FIG. 1, a connector evaluating adapter 1 is composed of a rectangular metal housing 3 and male and female connector terminal ends 5 and 7, outer ends of which are exposed at both ends of the metal housing 3. In the male connector terminal end 5, a ground electrode 5*a* houses pins 5*b*. As shown in FIG. 2, in the female connector terminal end 7, a ground electrode 7*a* houses an insulating plastic member 7*b* having openings 7*c* for receiving pins (not shown) of another connector to be engaged with the connector evaluating adapter 1. As shown in FIG. 1, the openings 7*c* are contiguous with female electrodes 7*d*, which are in electrical contact with the pins 5*b*. In the middle of the connector evaluating adapter 1, a transverse metal plate 9 is disposed parallel to pin and female electrode carrying faces of the male and female connector terminal ends 5 and 7. Both transverse ends of the metal plate 9 are electrically connected via support members 11*a* and 11*b*, respectively, to the ground electrode 5*a* of the male connector terminal end 5. Both ends of the metal plate 9 are also electrically connected via support members 11*c* and 11*d*, respectively, to the ground electrode 7*a* of the female connector terminal end 7. The pins 5*b* compose internal electrodes of through capacitors 13 extending through the metal plate 9. External electrodes 13*a* of the through capacitors 13 are electrically connected via the support members 11*a*, 11*b*, 11*c* and 11*d* to the ground electrodes 5*a* and 7*a*. The support members 11*a*, 11*b*, 11*c* and 11*d* have the same impedance and compose conductive members. As shown in FIG. 1, the male and female connector terminal ends 5 and 7 are opposed and soldered to the ends of the metal housing 3, thus electrically connecting the ground electrodes 5*a* and 7*a*.

In operation, electrical signals are supplied to either of the pins 5*b* or the female electrodes 7*d* and are transmitted through the through capacitors 13 to the other of the pins 5*b* and the female electrodes 7*d*. When noise is present, superimposed on electrical signals, the noise passes through the through capacitors 13 as a high-frequency alternating current, thus developing a short circuit, with respect to the noise, between the pins 5*b* and the metal plate 9 from which it is conducted via the support members 11*a*, 11*b*, 11*c* and 11*d* to the ground electrodes 5*a* and 7*a* of the male and female connector terminal ends 5 and 7. Thereby, noise is eliminated from electrical signals to be transmitted through the pins 5*b*. Since the support members 11*a*, 11*b*, 11*c* and 11*d* have the same impedance, the ground electrodes 5*a* and 7*a* can be kept equipotential as described later.

Figure 3:
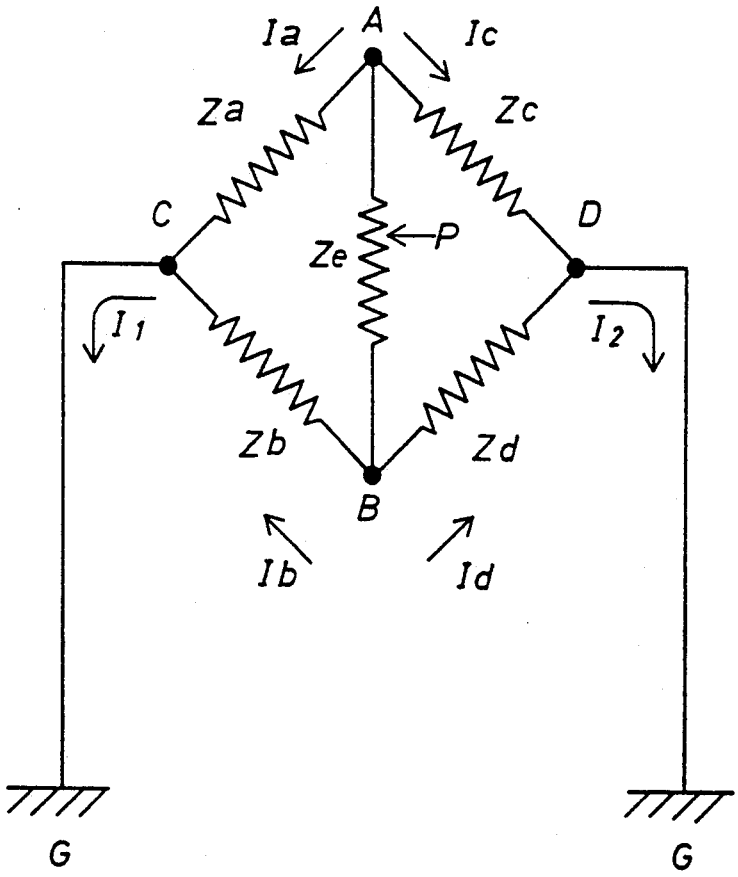
FIG. 3 is a schematic diagram showing an equivalent circuit of the connector evaluating adapter for explanation of the flow of noise superimposed on electrical signals.

Flow of noise superimposed on electrical signals will now be explained with reference to FIG. 3 illustrating an equivalent circuit. In the equivalent circuit, notation P is equivalent to a contact point between the external electrodes 13*a* of the through capacitors 13 and the metal plate 9; point A to a contact point between the metal plate 9 and the support members 11*a*, 11*c*; point B to a contact point between the metal plate 9 and the support members 11*b*, 11*d*; point C to the ground electrode 5*a*; point D to the ground electrode 7*a*; notation G to the metal housing 3; notations Za, Zb, Zc, and Zd to the impedances of the support members 11*a*, 11*b*, 11*c* and 11*d*, respectively; notation Ze to the impedance of the metal plate 9; notations Ia, Ib, Ic and Id to currents flowing through the support members 11*a*, 11*b*, 11*c* and 11*d*, respectively; notation I1 to a current flowing from the ground electrode 5*a* to the metal housing 3; and notation I2 to a current flowing from the ground electrode 7*a* to the metal housing 3. Since the support members 11*a*, 11*b*, 11*c* and 11*d* have the same impedance, the following equation is established:

$$Za=Zb=Zc=Zd \ldots \quad (1)$$

Where no noise is superimposed on electrical signals, the points C and D are electrically connected via the metal housing 3 and are equipotential. When noise superimposed on electrical signals enters a given point of the impedance Ze, noise is separated first at the position P and further at the points A and B to form currents Ia, Ib, Ic and Id. Since the impedance between the points A and C equals that between the points A and D, the following equation is established:

$$Ia=Ic \ldots \quad (2)$$

Similarly, the impedance between the points B and C equals that between the points B and D, thus establishing the following equation:

$$Ib=Id \ldots \quad (3)$$

Since the following equations are established, the current I1 equals the current I2:

$$I1=Ia+Ib \quad I2=Ic+Id \ldots \quad (4)$$

Consequently, the points C and D or the ground electrodes 5*a* and 7*a* are kept equipotential, and no current flows through the metal housing 3.

If either of Za, Zb, Zc and Zd has a different impedance value and the equation (1) fails to be established, the currents I1 and I2 generally do not equal each other. Therefore, a current of Il minus I2 flows from the ground electrode 5*a* through the metal housing 3 toward the ground electrode 7*a*. The higher the frequency of a current flowing through the metal housing 3 is, the larger the absolute difference between the currents I1 and I2 is. At the same time, the impedance to the metal housing 3 becomes conspicuous, thus creating a significant potential difference between the points C and D or between the ground electrodes 5*a* and 7*a*. Even after superimposed noise is eliminated from electrical signals by the through capacitors 13, the electrical potential of the metal plate 9 has a middle value between the electrical potentials of the ground electrodes 5*a* and 7*a*. Therefore, the potential difference remains between the metal plate 9 and the ground electrodes 5*a*, 7*a*, until the ground electrodes 5*a* and 7*a* again become equipotential. To make the ground electrodes 5*a* and 7*a* equipotential, a current flows through the metal housing 3, thus generating another noise. If the metal plate 9 is not placed at an electrical midpoint between the ground electrodes 5*a* and 7*a* of the connector terminal ends 5 and 7, the aforementioned problem occurs.

In the connector evaluating adapter 1 of the first embodiment, however, the support members 11*a*, 11*b*, 11*c* and 11*d* have the same impedance, thus establishing the equation (1). The metal plate 9 is placed at an electrical midpoint between the ground electrodes 5*a* and 7*a*. Even when a high-frequency noise flows through the ground electrodes 5*a* and 7*a*, the ground electrodes 5*a* and 7*a* maintain an equipotential. Therefore, after noise is eliminated, the metal plate 9 can again become essentially equipotential to the ground electrodes 5*a* and 7*a*, and no current flows through the metal housing 3, thus no noise is generated.

A method for evaluating a noise eliminating effect of, for example, a noise filtering male connector by using the connector evaluating adapter 1 of the first embodiment will now be explained. The through capacitors 13 of the connector evaluating adapter 1 require to be of the same type as through capacitors of the noise filtering male connector to be evaluated.

Specifically, a usual male connector (not shown) having no noise filtering function is first attached to an electronic circuit (not shown). Subsequently, the female connector terminal end 7 of the connector evaluating adapter 1 is engaged with the male connector. The metal plate 9 is electrically connected via the ground electrode 7*a* to a ground electrode (not shown) of the male connector. The metal plate 9 then becomes equipotential to the ground electrode of the male connector. Therefore, the noise eliminating effect of the through capacitors 13 coincides to that of through capacitors of a noise filtering connector for which the male connector is substituted. By supplying various electrical signals to the pins 5*b* of the male connector terminal end 5 of the connector evaluating adapter 1, the noise eliminating effect of the through capacitors 13 is evaluated. Such evaluation can be applied to choice of capacitors to reproduce the noise limiting effect therein of the noise filtering connector.

For example, when a capacitance of through capacitors for use in a noise filtering connector is determined, multiple connector evaluating adapters 1 having the through capacitors 13 of various capacitances are prepared. A connector having no noise filtering function is attached to an electronic circuit for use. The connector evaluating adapters 1 are sequentially engaged with the usual connector attached to the electronic circuit. By comparing the noise eliminating effects of the connector evaluating adapters 1, the connector evaluating adapter 1 having the capacitance most suitable to the electronic circuit is selected. The capacitance of the through capacitors 13 of the connector evaluating adapter 1 is chosen as that of through capacitors of the noise filtering connector. The capacitance of the through capacitors of the noise filtering connector can thus easily be determined without attaching multiple noise filtering connectors by turns to the electronic circuit.

Figure 4:
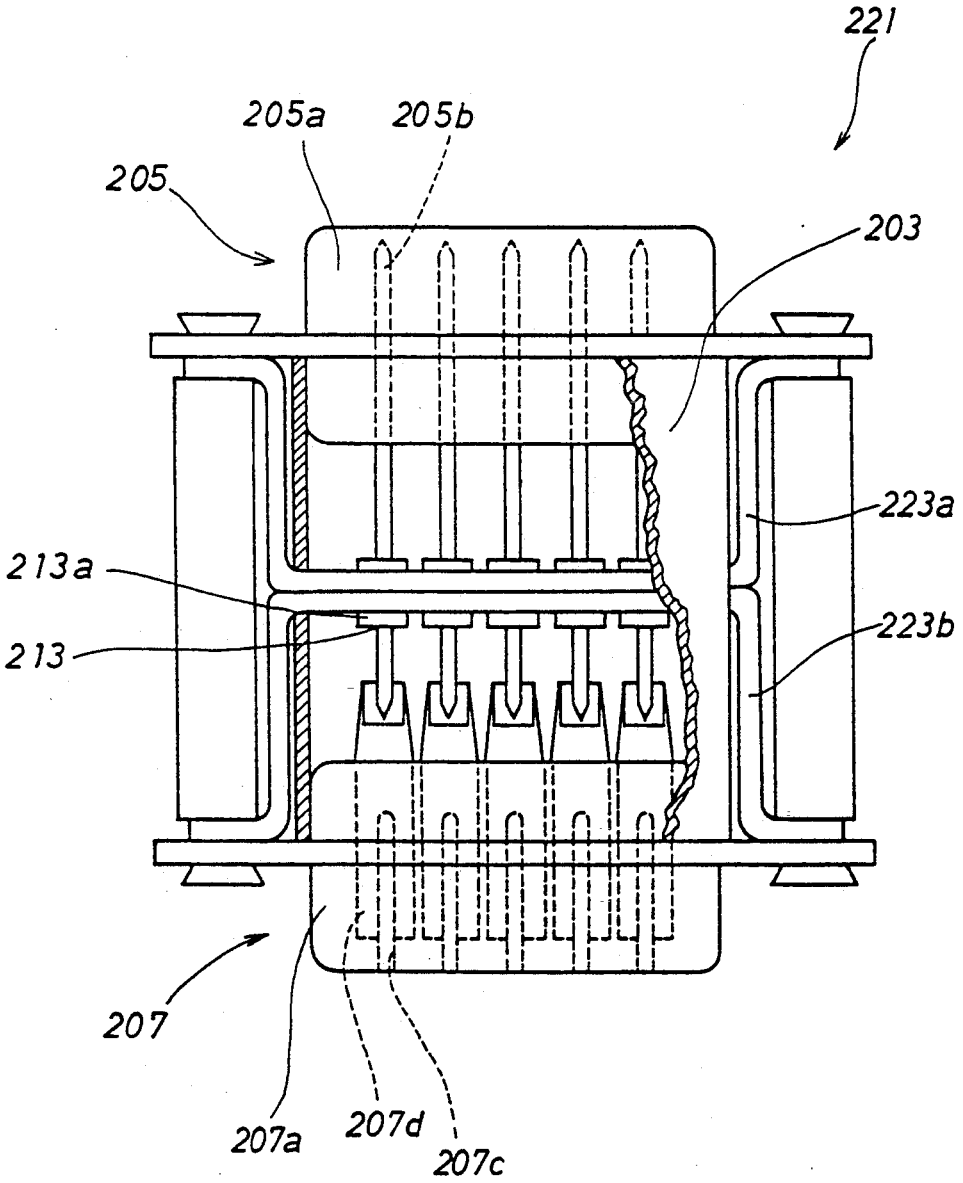
FIG. 4 is a diagrammatic view showing an internal structure of a connector evaluating adapter of a second embodiment of the present invention.
Figure 5:
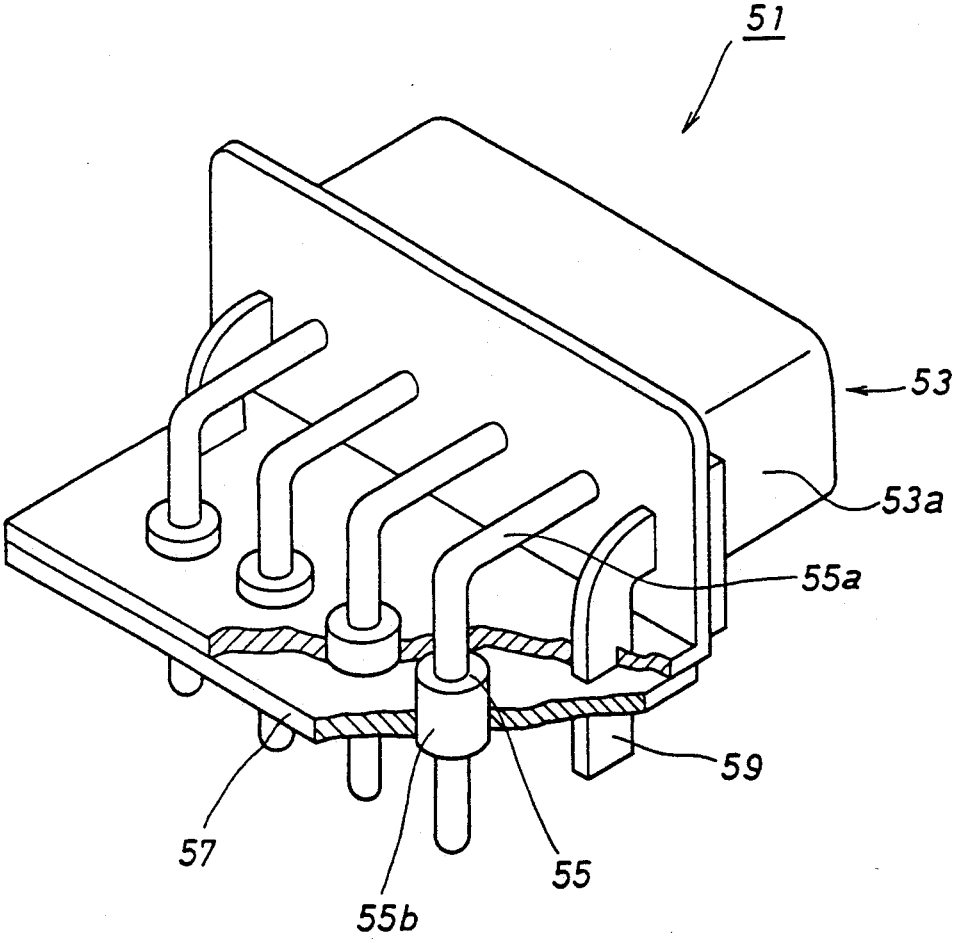
FIG. 5 PRIOR ART
FIG. 5 is a perspective view of a known noise filtering connector.

A second embodiment according to the invention will now be described with reference to FIG. 4. A connector evaluating adapter 221 is composed of two metal plates 223*a* and 223*b* made of identical electrically conductive material. Both ends of the metal plates 223*a* and 223*b* are connected to both ends of ground electrodes 205*a* and 207*a*. The metal plates 223*a* and 223*b* compose conductive members as well as support members. Therefore, the number of the components of the connector evaluating adapter 221 is reduced. The metal plates 223*a* and 223*b* perform the function of multiple features from the first embodiment. The components of the connector evaluating adapter 221 identical to those of the connector evaluating adapter 1 have the same last two digits as those of the corresponding components of the connector evaluating adapter 1, and detailed explanation is therefore omitted.

In another known noise filtering connector, signal electrodes are connected to internal electrodes of through capacitors, which are disposed in parallel and are passed through a board member composed of ferrite or other magnetic material. Noise superimposed on electrical signals is eliminated by the through capacitors and the board member. A connector evaluating adapter for evaluating the noise eliminating effect of such a noise filtering connector could be composed by placing a board member of magnetic material in the metal housing 3, 203 and passing the pins 5*b*, 205*b* through the board member.

As aforementioned, in the connector evaluating adapter according to the invention, the ground electrodes of the pair of the connector terminal ends can be kept almost equipotential with the metal plate through which the through capacitors are placed. Consequently, the noise eliminating effect of a noise filtering connector having through capacitors identical to those of the connector evaluating adapter can be evaluated easily. Specifically, a usual connector having no noise filtering function is attached to an electrode circuit, and is engaged with the connector terminal end of the connector evaluating adapter. The metal plate of the connector evaluating adapter becomes equipotential to a ground electrode of the usual connector. The noise eliminating effect of the through capacitors of the connector evaluating adapter coincides with that of the through capacitors of the noise filtering connector for which the usual connector is substituted for evaluation purpose. Therefore, when the adaptability to the electronic circuit of multiple noise filtering connectors is compared, the connector evaluating adapters can be attached sequentially to the usual connector attached to the electronic circuit. The noise filtering connector most suitable to the electronic circuit can be selected easily without attaching multiple noise filtering connectors by turns to the electronic circuit.

This invention has been described above with reference to preferred embodiments as shown in the drawings. Modifications and alterations may become apparent to one skilled in the art upon reading and understanding the specification. Despite the use of embodiments for illustration purposes, however, it is intended to include all such modifications and alterations within the scope and spirit of the appended claims.

Wherefore, having thus described the present invention, what is claimed is:

1. A connector evaluating adapter for evaluating a noise eliminating effect of a noise filter connector, comprising:

a pair of connector ends, each having a ground electrode;

at least one signal electrode extending between the connector ends;

a through capacitor encompassing and connected to said signal electrode and defining an external electrode electrically conductively contacting a metal plate;

an electrically conductive housing encompassing said through capacitor and electrically conductively interconnecting said ground electrodes;

conductive means electrically conductively interconnecting said metal plate and said ground electrodes, said metal plate being disposed between said ground electrodes;

wherein said connector ends are symmetrically opposed, said ground electrodes encompass said signal electrode at their respective connector ends, said through capacitors are disposed midway between said connector ends and said plate is disposed at an electrical midpoint between said ground electrodes; and said plate is disposed transversely of said signal electrode and extends through said housing to said conductive means and said conductive means comprises members interconnecting opposed ends of said plate and said ground electrodes.

2. An adapter according to claim 1 wherein said members are integral with said plate.

3. An adapter according to claim 1 wherein said members all have the same impedance whereby said ground electrodes have equipotential.

4. An adapter according to claim 3 wherein said plate is symmetrically centered between said ground electrodes and said members are of substantially the same length to extend each from said plate to a said ground electrode.

5. An adapter according to claim 1 wherein said connector ends are respectively male and female.

6. An adapter according to claim 1 wherein there are a plurality of said signal electrodes all encompassed by a said ground electrode at each connector end and each signal electrode is encompassed by a separate through capacitor.

* * * * *